US005624121A

United States Patent [19]

Stern

[11] Patent Number: 5,624,121

[45] Date of Patent: Apr. 29, 1997

[54] STACKED POGS WITH STRIKING TOOL METHOD

[75] Inventor: Israel Stern, Raanana, Israel

[73] Assignee: N. B. Hoppies Marketing (1994) Ltd., Raanana, Israel

[21] Appl. No.: 723,349

[22] Filed: Sep. 30, 1996

[51] Int. Cl.[6] ..... A63F 9/02

[52] U.S. Cl. ..... 273/317; 273/353; 273/290; 473/516; 473/570; 473/588

[58] Field of Search ..... 273/424, 126 R, 273/128 R, 128 CS, 128 A, 129 K, 129 C, 290, 447, 140, 353, 448

[56] References Cited

U.S. PATENT DOCUMENTS

| | | | |
|---|---|---|---|
| 1,368,401 | 2/1921 | Kettle | 273/126 R |
| 2,159,966 | 5/1939 | Dunham | 273/126 R |
| 2,798,722 | 7/1957 | Fluhrer | 273/424 |
| 3,201,128 | 8/1965 | Palovik | 273/424 |
| 3,544,113 | 12/1970 | Hand | 273/424 |
| 4,325,556 | 4/1982 | De Canto et al. | 273/424 |
| 4,354,326 | 10/1982 | Mathews | 273/424 |
| 4,432,544 | 2/1984 | Wakimura | 273/140 |
| 4,773,643 | 9/1988 | Mizunuma | 273/445 |
| 5,403,016 | 4/1995 | Kudo | 273/424 |
| 5,458,342 | 10/1995 | Hernandez | 273/447 |

*Primary Examiner*—William M. Pierce
*Attorney, Agent, or Firm*—Sol Sheinbein

[57] ABSTRACT

A game comprising a plurality of substantially rigid playing discs each having an upper and lower surface bound by a circumferential ridge which is up-raised with respect to the upper and lower surfaces so as to provide a recess in the upper surface for accommodating therein a corresponding protrusion in the lower surface of an adjacent playing disc placed thereon, the upper surface having a visual image thereon. In use, the playing discs are stacked one top of another and each player is provided with a turn for striking a topmost one of the playing discs towards a periphery thereof so as thereby to upturn a number of the playing discs in the stack, the player claiming for himself those discs whose upper surface is downmost. An object of the game is to maximize the number of upturned playing discs.

11 Claims, 2 Drawing Sheets

STACKED POGS WITH STRIKING TOOL METHOD

FIELD OF THE INVENTION

This invention relates to a child's game of the kind where an object is to collect as many game pieces as possible.

BACKGROUND OF THE INVENTION

During the past few years, so-called pog have become popular. This child's game consists of a large number of stiff cardboard discs each bearing on one surface thereof a pattern or picture. A very large number of different patterns or pictures is available so that, on average, a child would have to collect quite a large number of pogs before collecting two pogs bearing the same pattern or picture thereon. Thus, an object of the game is to collect as many different patterns or pictures as possible.

Pogs form part of a child's game which extends beyond the mere collection of different patterns or pictures. For example, children can drop pogs from different heights, each child taking a turn and each successive child attempting to aim his "pog" so as to fall on the pog of his predecessor. When this happens, he claims not only his own pogs but also those of his predecessor. In such manner, he can increase the number of pogs in his collection at the expense of his playing partner.

Alternatively, pogs can be thrown: the playing partner who manages to throw his pog the furthest claiming all of his partner's pogs also.

Pogs, as they are currently known, suffer from several drawbacks. First, they are made of cardboard which is, inevitably, fragile and apt to become tattered and dog-eared in time. In cross-section, they are absolutely rectangular so that each pog, when laid on top of another, rests thereon with its lower surface in absolute, planar contact therewith. As a result, there is no natural tendency for an individual pog to up-turn consequent to a blow being applied to an edge thereof. Moreover, they are apt to slide one on top of the other when stacked together. Thus, whilst pogs are eminently suited for the kinds of games described, they are not particularly well suited for games of the kind where playing pieces are stacked one on top of the other, since doing so would nevertheless allow each pog to slide relative to its neighbor. Of course, such a drawback would easily be overcome by applying some kind of recess or internal depression to each pog. However, this is difficult to do with cardboard discs: particularly in a manner so that the discs maintain their pressed shape with time.

SUMMARY OF THE INVENTION

It is thus an object of the invention to provide a child's game of the kind described wherein the aforementioned drawbacks are significantly reduced or eliminated.

According to a broad aspect of the invention there is provided a game comprising a plurality of substantially rigid playing discs each having an upper and lower surface bound by a circumferential ridge which is up-raised with respect to the lower and the upper surface so as to provide a recess in the upper surface for accommodating therein a corresponding protrusion in the lower surface of an adjacent playing disc placed thereon, the upper surface having a visual image thereon;

the playing discs being stacked one top of another and each player being provided with a turn for striking a topmost one of the playing discs towards a periphery thereof so as thereby to upturn a number of the playing discs in the stack, said player claiming for himself said number of discs whose upper surface is downmost;

an object of the game being to maximize said number of upturned playing discs.

Optionally, the game further includes a tool for striking the discs: the tool either being in the same of a disc-shaped element having a mass which is substantially greater than that of each of the playing discs or, alternatively, is hand-shaped having a handle for holding by a player.

Preferably, the playing discs are formed of a ferromagnetic material so as to be susceptible to attraction by a magnetic tool, thereby extending the range of possibilities to which the playing discs may be put.

BRIEF DESCRIPTION OF THE DRAWINGS

In order to understand the invention and to see how the same may be carried out in practice, some preferred embodiments will now be described by way of non-limiting example, with reference to the accompanying drawings, in which.

DETAILED DESCRIPTION OF PREFERRED EMBODIMENTS

Figure 1:
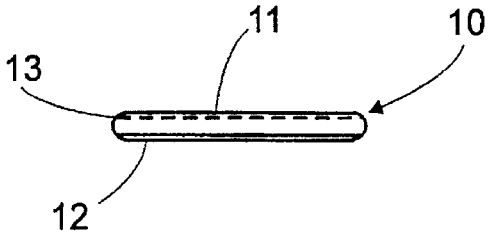
FIG. 1 shows schematically a side elevation of a playing disc according to the invention.

FIG. 1 shows, in end elevation, a playing disc 10 having upper and lower surfaces 11 and 12, respectively, bound by a circumferential ridge 13 which is up-raised with respect to the lower surface 12 so that when the upper and playing disc 10 is placed on a flat surfaces 11 and, the circumferential ridge 13 is vertically displaced with respect to the flat surface so that striking a periphery of the playing disc 10 tends to up-turn it so that its lower surface 12 becomes uppermost.

The playing disc 10 is preferably formed of tin metal of the kind used in manufacturing tin cans. In this case, the playing disc 10 resembles a lid of the tin can (prior to assembly thereof with the cylindrical wall element) except that during the manufacture of tin cans and prior to final assembly thereof, the edge of the lid is exposed presenting a sharp edge which is, of course, unsuitable for a child's game. To this end, the circumferential edge of the lid must be folded so as to present a substantially round edge to the playing disc, thereby rendering the playing disc absolutely safe. At the same time the upper surface of the playing disc must be slightly depressed, as explained above, in order to provide an internal recess shown in dotted line in FIG. 1 so that the lower surface 12 projects slightly beneath the circumferential edge 13.

Figure 2:
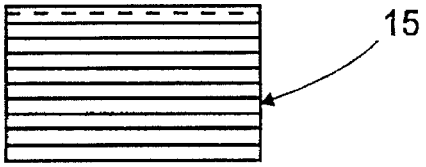
FIG. 2 shows in cross-section a stack of playing discs.

Owing to the fact that each playing disc 10 is slightly recessed, the playing discs can be stacked one on top of the other so as to form a stack of playing discs 15 as shown in FIG. 2.

Figure 3:
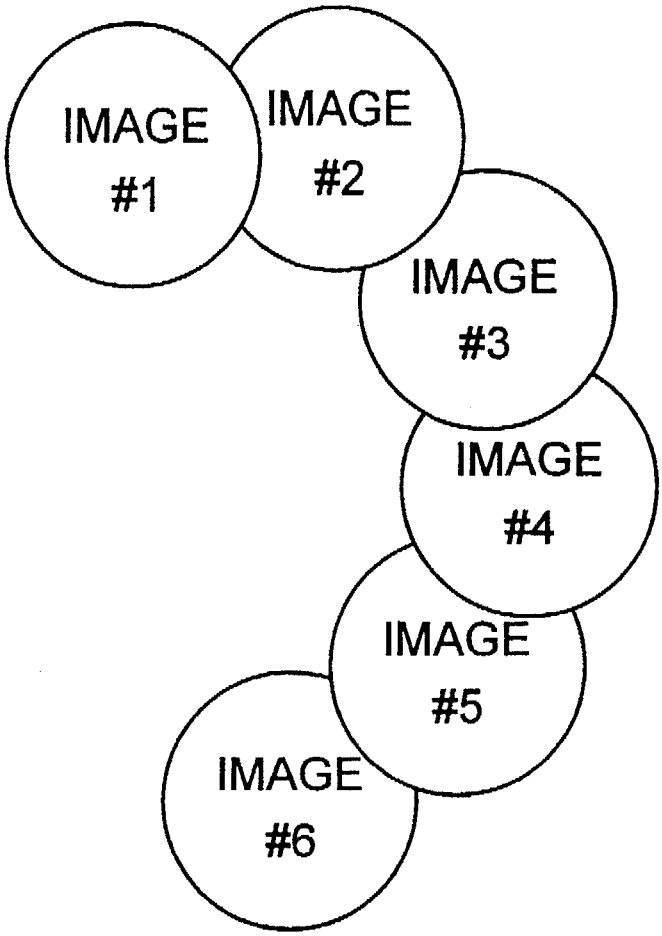
FIG. 3 shows semi-pictorially the stack shown in FIG. 2 spread out so as to reveal different visual images on the upper surface of each playing disc.

FIG. 3 shows some of the uppermost playing discs in the stack 15 spread apart to reveal on the upper surface 11 of each disc a visual image shown symbolically as IMAGE #1, IMAGE #2 . . . up to IMAGE #6. In practice, of course, very many different images may be provided so that one object of the game becomes simply to collect as many different images as possible. To this extent, it may be desirable to distribute a relatively small number of selected ones of the IMAGES so that, throughout a given population of children, the selected discs will be relatively rare.

Although the playing discs 10 may be used in a manner similar to the pogs described above, the provision of the up-raised circumferential edge 13 renders the playing discs 10 of the invention amenable to a variety of different games. Some of these will now be described but only to the extent that different components are required. It will be appreciated that the game is amenable to modification subject only to the imagination of the player.

Figure 4:
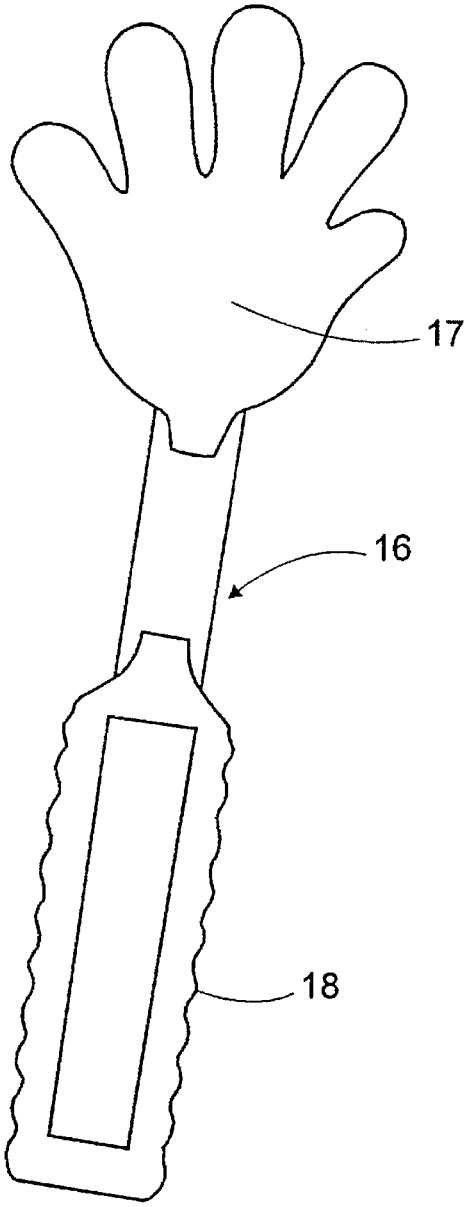
FIG. 4 illustrates pictorially a hand-shaped tool for striking an uppermost disc in the stack shown in FIG. 2.

FIG. 4 shows a hand-shaped tool depicted generally as 16 and having a hand-shaped operative end 17 connected to a handle 18 provided with protrusions so as to aid gripping by a player. The hand-shaped tool 16 is preferably formed of an integral plastics molding. In use, the hand-shaped tool 16 is held by a player who then strikes the uppermost playing disc in the stack 15 (shown in FIG. 2) with the object of up-turning as many playing discs 10 as possible. When used in this manner, the player claims for himself or for herself those discs which are successfully up-turned so that their lower surface 12 becomes uppermost.

Figure 5A:
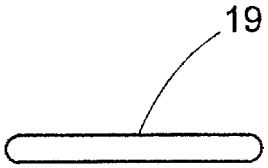
FIGS. 5*a* and 5*b* show, respectively, in end and plan elevations a disc-shaped tool for striking an uppermost playing disc in the stack of FIG. 2.
Figure 5B:
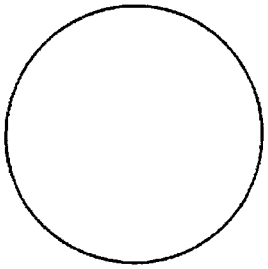

FIGS. 5*a* and 5*b* show in end and plan elevations, respectively, an alternative tool 19 in the form of a disc-shaped element having a mass which is substantially greater than that of the playing discs 10. The tool 19 is also preferably formed of plastics and is used in a similar manner to the tool 18 so as to strike an edge of the uppermost disc in the stack 15.

Figure 6:
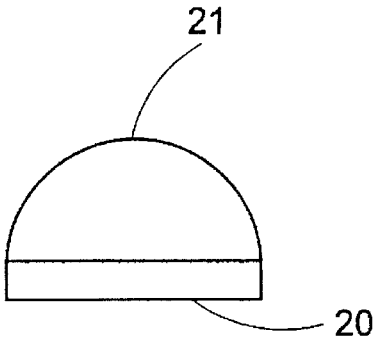
FIG. 6 shows schematically a magnetic tool for throwing towards the stack of playing discs shown in FIG. 2.

FIG. 6 shows schematically a magnetic tool 20 having a length of string 21 attached thereto a remote end of which is held by a player so as to throw the tool 20 towards the stack 15 and effect magnetic contact with as many of the playing discs 10 as possible. By such means, some of the uppermost discs in the stack 15 can be removed by the magnetic tool 20 and those which are successfully removed in this manner are claimed by the player who threw the magnetic tool 20.

What all of these games have in common is the use of a substantially rigid disc having a circumferential edge which is up-raised with respect to of the disc, thereby enabling a plurality of playing discs to be stacked one on top of the other so that the protrusion extending from the lower surface of each playing disc is accommodated within the recess in the upper surface of an adjacent, lower playing disc.

I claim:

1. A method of playing a game comprising:

providing a plurality of substantially rigid playing discs, each disc comprising a substantially planar lower surface, an upper surface and a circumferential ridge upraised with respect to said upper and lower surfaces so as to provide a recess in the upper surface for accommodating therein the lower surface of an adjacent playing disc placed thereon, said upper surface having a visual image thereon;

stacking said discs one atop another so that said recess of a lower disc in the stack accommodates therein the lower surface of an adjacent disc placed thereon; and a player striking the topmost one of said discs so as to thereby upturn a number of the playing discs in the stack and claiming those discs whose upper surfaces are downmost.

2. A method of playing a game according to claim 1, further including providing a tool for striking said playing discs.

3. A method of playing a game according to claim 2, wherein the tool is a disc-shaped element having a mass which is substantially greater than that of each of the playing discs.

4. A method of playing a game according to claim 2, wherein the tool has a handle for holding by the player, and an operative striking end being hand-shaped.

5. A method of playing a game according to claim 1, wherein the playing disc is formed of metal.

6. A method of playing a game according to claim 5, further including providing a tool for striking said playing discs.

7. A method of playing a game according to claim 6, wherein the metal is ferromagnetic, and the tool is magnetic.

8. A method of playing a game according to claim 7, wherein the step of striking the topmost one of said discs comprises having the tool controlled via a string attached thereto and thrown towards the stack of playing discs for effecting magnetic contact therewith.

9. A method of playing a game according to claim 1, wherein each of the playing discs has a limited number of visual images on its upper surface and an object of the game is to collect as many of said limited number of visual images as possible.

10. A method of playing a game according to claim 1, wherein the visual images are printed on to the upper surface of each playing disc.

11. A method of playing a game according to claim 1, wherein the visual images are painted on to the upper surface of each playing disc.

* * * * *